US008720114B2

(12) United States Patent
Matsushita

(10) Patent No.: US 8,720,114 B2
(45) Date of Patent: May 13, 2014

(54) WINDOW REGULATOR

(75) Inventor: Masayuki Matsushita, Takarazuka (JP)

(73) Assignee: Hi-Lex Corporation, Hyogo (JP)

( * ) Notice: Subject to any disclaimer, the term of this patent is extended or adjusted under 35 U.S.C. 154(b) by 0 days.

(21) Appl. No.: 13/386,708

(22) PCT Filed: Jul. 27, 2010

(86) PCT No.: PCT/JP2010/062570
§ 371 (c)(1),
(2), (4) Date: Jan. 24, 2012

(87) PCT Pub. No.: WO2011/013641
PCT Pub. Date: Feb. 3, 2011

(65) Prior Publication Data

US 2012/0117883 A1 May 17, 2012

(30) Foreign Application Priority Data

Jul. 27, 2009 (JP) ..... 2009-174310

(51) Int. Cl.
*E05F 11/48* (2006.01)

(52) U.S. Cl.
USPC ..... 49/352; 49/349

(58) Field of Classification Search
USPC ..... 49/348, 349, 352, 374, 502
See application file for complete search history.

(56) References Cited

U.S. PATENT DOCUMENTS 4,241,542 A * 12/1980 Podolan et al. ..... 49/352
5,099,611 A * 3/1992 Kracht et al. ..... 49/211
5,740,630 A * 4/1998 Medebach ..... 49/352
5,749,174 A * 5/1998 Mariel ..... 49/352
6,050,029 A * 4/2000 Simon et al. ..... 49/352
6,115,966 A * 9/2000 Shibata ..... 49/352
7,076,918 B2 * 7/2006 Tatsumi et al. ..... 49/352
7,610,720 B2 * 11/2009 Kirejczyk et al. ..... 49/352
7,765,739 B2 * 8/2010 Munezane et al. ..... 49/352
7,882,658 B2 * 2/2011 Staser et al. ..... 49/352

(Continued)

FOREIGN PATENT DOCUMENTS

JP 63-132080 U 8/1988
JP 10-315760 A 12/1998

(Continued)

OTHER PUBLICATIONS

International Search Report of corresponding PCT Application No. PCT/JP2010/062570.

*Primary Examiner* — Katherine Mitchell
*Assistant Examiner* — Shiref Mekhaeil
(74) *Attorney, Agent, or Firm* — Global IP Counselors, LLP

(57) ABSTRACT

A window regulator prevents a carrier plate from derailing from a guide rail by preventing the generation of a force which is applied when the carrier plate and a stopper member collide with each other and which lifts up the carrier plate. In the window regulator, an impact absorption body is installed in a press fitting recess of the carrier plate. The impact absorption body is made of an elastic material for absorbing an impact caused by a collision between the carrier plate and the stopper member that regulates a slide position of the carrier plate. A collision surface formed on the stopper member is tilted toward the carrier plate with respect to a plane that is perpendicular to an axis of the guide rail such that the collision surface pushes the carrier plate down toward the guide rail when it collides with the impact absorbing body.

8 Claims, 6 Drawing Sheets

(56) References Cited

U.S. PATENT DOCUMENTS

| | | | | |
|---|---|---|---|---|
| 8,042,302 | B2 * | 10/2011 | Kruger et al. | 49/375 |
| 8,127,495 | B2 * | 3/2012 | Eckhardt et al. | 49/352 |
| 2004/0154227 | A1 * | 8/2004 | Yoshimura | 49/352 |
| 2006/0037250 | A1 | 2/2006 | Staser | |
| 2006/0196122 | A1 * | 9/2006 | Urieta et al. | 49/502 |
| 2007/0151158 | A1 * | 7/2007 | Fenelon | 49/349 |
| 2007/0251148 | A1 * | 11/2007 | Watson et al. | 49/352 |

FOREIGN PATENT DOCUMENTS

| | | | |
|---|---|---|---|
| JP | 2002-129831 | A | 5/2002 |
| JP | WO-02/075090 | A1 | 9/2002 |
| JP | 2007-177421 | A | 7/2007 |

* cited by examiner

WINDOW REGULATOR

CROSS-REFERENCE TO RELATED APPLICATIONS

This application is a U.S. National stage application of International Application No. PCT/JP2010/062570, filed Jul. 27, 2010, which claims priority claims priority under 35 U.S.C. §119(a) to Japanese Patent Application No. 2009-174310, filed in Japan on Jul. 27, 2009, the entire contents of which is hereby incorporated by reference.

TECHNICAL FIELD

The present invention relates to a window regulator in which a tilted structure is provided on a carrier plate or a stopper member.

BACKGROUND

For some time, window regulators have generally been used in vehicles to raise and lower a window pane. A window regulator comprises: a guide rail that extends along a movement direction of a window pane; a drive section attached to a lower end of the guide rail; a drum that is rotated by a torque received from the drive unit; a carrier plate that is slidably mounted on the guide rail and serves to support the window pane; two power transmitting members each having one end connected to the drum and another end connected to the carrier plate; and a guide and pulley that are attached to an upper end of the guide rail and serve to change an arrangement direction of one of the power transmitting members.

Vehicle doors can be roughly divided into types that have a sash for regulating an upper end position of the window pane and types that do not have a sash. The method of regulating the upper end position of the window pane is different for each type. In a door having a sash, the upper end position of the window pane is regulated by the window pane contacting an upper portion of the sash. In a door not having a sash, the upper end position of the window pane is regulated by the carrier plate contacting a stopper member provided on the guide rail or other portion. When the carrier plate contacts the stopper member, the motor is restrained and a large electric current flows, resulting in a possibility that the motor and/or a control board of the motor will be damaged by heat. Therefore, a circuit breaker or a PTC thermistor is provided on the control board to shut off electric power to the motor and stop the motor when a large electric current flows.

When contact of a carrier plate against a stopper member provided on a guide rail or the like is used as the regulating method, an impact absorption body made of rubber or another elastic material is provided in-between to absorb the impact occured at the time of contact.

For example, Laid-Open Japanese Utility Model Application Publication No. 63-132080 (Patent Document 1) discloses a window regulator having a damping member and a carrier plate. The damping member comprises a damping main body fitted into a wire guide member provided on a lower end portion of a guide rail and a mounting leg section that engages with an engaging hole of the guide rail. The carrier plate is provided with a contact member that contacts the damping member.

Laid-Open Japanese Patent Application Publication No. 2002-129831 (Patent Document 2) discloses a window regulator having a damping member and a carrier plate. The damping member comprises a circular arc-shaped contact section and an insertion section. The contact section is assembled with a cable guide provided on a lower end portion of a guide rail and contacts the carrier plate, and the insertion section has a narrower width than the contact section. The carrier plate has a contact section that contacts the damping member.

SUMMARY

With the window regulators presented in Patent Document 1 and Patent Document 2, when the carrier plate sliding along the guide rail contacts the stopper member in a tilted state, a force acts on the carrier plate in a direction of derailing the carrier plate from the guide rail and causes the carrier plate to derail from the guide rail.

As shown in FIG. 7A, a carrier plate 400 slides in a rightward direction along a guide rail 420 and collides with a stopper member 430. The carrier plate 400 and the guide rail 420 are fitted together with a gap in-between in order to reduce a sliding resistance. Consequently, there are times when the carrier plate 400 contacts the stopper member 430 in a straight orientation and other times when the carrier plate 400 contacts the stopper member 430 in a tilted orientation or the carrier plate 400 contacts the stopper member 430 in a straight orientation and then becomes a tilted state (see FIG. 7B).

In such a case, as shown in FIG. 7B, an acting point A is a contact point where an impact absorbing body 450 and the stopper member 430 contact each other, and a force applying point P is an engaging point where a cable end 460 fixed to an end portion of an inner cable serving as a power transmitting member engages with the carrier plate 400. Since the force applying point P is lower than the acting point A, if the carrier plate is moved further in the rightward direction, then the impact absorbing body 450 will compress in a tilted direction while the carrier plate 400 will tend to rotate in the direction of the arrow L about a fulcrum point F, which is a fitting point between the carrier plate 400 and the guide rail 420.

Since it is possible for the carrier plate 400 to move rightward in this state, a motor drive circuit will continue powering the motor. Therefore the force applied at the force applying point P will cause the carrier plate 400 to rotate in the direction of the arrow L such that the carrier plate 400 lifts up from the guide rail 420. Thus, the carrier plate 400 will be in the state shown in FIG. 7C and become derailed from the guide rail 420.

The phenomenon of the carrier plate lifting from and derailing from a guide rail occurs after an impact absorbing body provided on the carrier plate contacts the stopper member or an impact absorbing body provided on the stopper member contacts the carrier plate. The disclosed window regulator is intended to provide a structure of a carrier plate or a stopper member that serves to solve the phenomenon.

A disclosed window regulator is configured to open and close a window pane and comprises a guide rail, a carrier plate, and a stopper member. The guide rail is fixed to a door of a vehicle. The carrier plate is slidably attached to the guide rail and comprises a guide rail fitting section that fits together with the guide rail. A window pane fastening section and a connecting section that connects to a power transmitting means for transmitting power generated by a drive section. The stopper member regulates a slide position of the carrier plate. An impact absorbing body made of an elastic material is attached to one of the carrier plate and the stopper member, and a collision surface for colliding with the impact absorbing body is formed on the other of the stopper member and the carrier plate. The collision surface has such a shape that it pushes the carrier plate down toward the guide rail when it collides with the impact absorbing body.

(1) In the disclosed window regulator, an impact absorbing body made of an elastic material is attached to the carrier plate and a collision surface for colliding with the impact absorbing body is formed on the stopper member, or an impact absorbing body made of an elastic material is attached to the stopper member and a collision surface for colliding with the impact absorbing body is formed on the carrier plate. Additionally, the collision surface has such a shape that the carrier plate is pushed down toward the guide rail when it collides with the impact absorbing body. As a result, even if the impact absorbing body collides with the collision surface, a force acting in a direction of derailing the carrier plate from the guide rail can be prevented from acting on the carrier plate.

(2) If the collision surface is tilted so as to form an acute angle with respect to the guide rail, then the tilted surface can prevent a force from acting on the carrier plate in a direction of derailing from the guide rail.

(3) If an opposing surface that faces opposite the collision surface is formed on either the carrier plate or the stopper member and is parallel to the collision surface, then a force can be prevented from acting on the carrier plate in a direction of derailing the carrier plate from the guide rail when the collision surface and the opposing surface contact each other.

(4) If the opposing surface has a recess for attaching the impact absorbing body, then the impact absorbing body can be reliably supported in the recess.

(5) If the stopper member is provided as an integral unit with a housing of the drive section, then the number of parts making up the window regulator can be reduced and a stiffness of the stopper member can be increased.

BRIEF DESCRIPTION OF THE DRAWINGS

Referring now to the attached drawings which form a part of this original disclosure.

DETAILED DESCRIPTION OF EMBODIMENTS

A window regulator according to the present invention will now be explained in detail with reference to the appended drawings.

Figure 1:
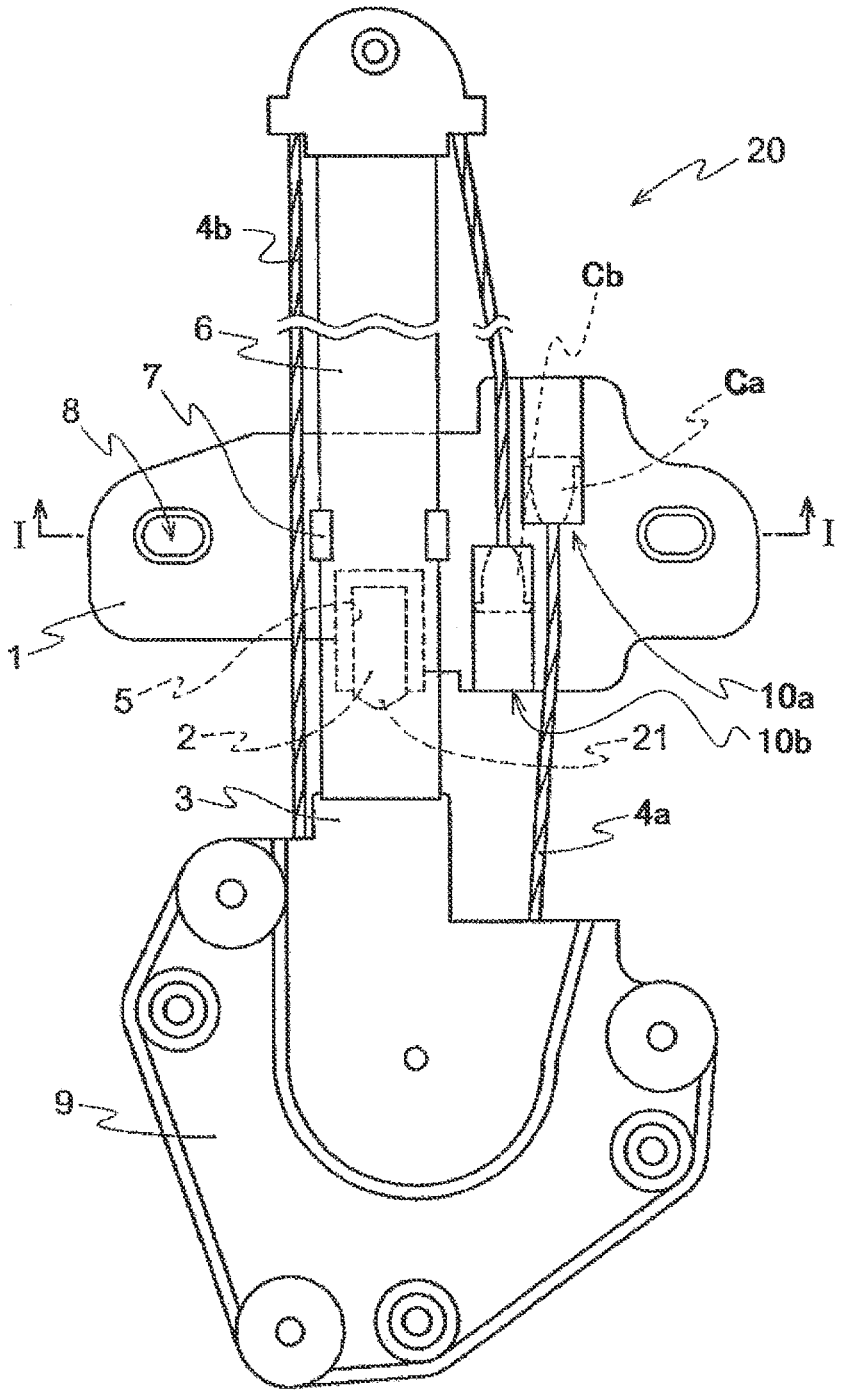
FIG. 1 is a drawing for explaining a window regulator according to one illustrative embodiment.
Figure 2:
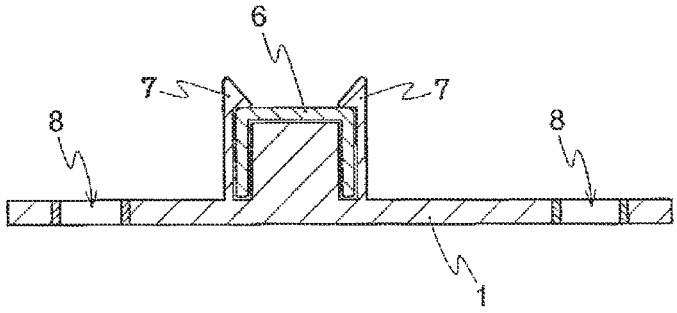
FIG. 2 is a cross sectional view of the window regulator of FIG. 1 taken along a section line I-I.
Figure 3:
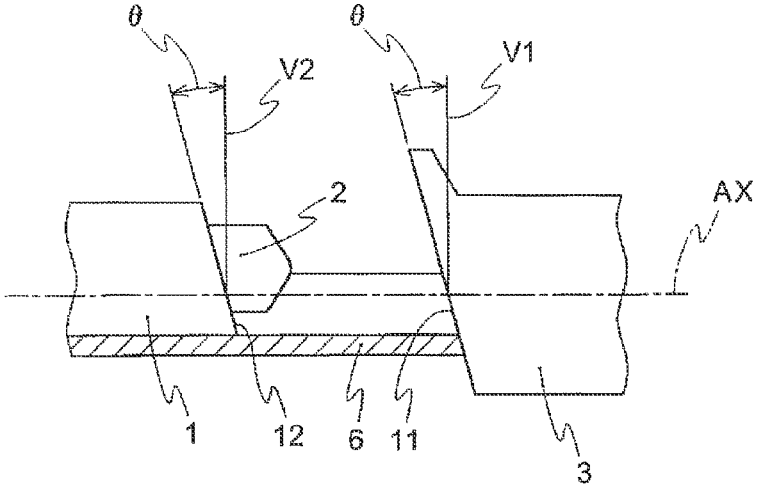
FIG. 3 is a drawing for explaining an angle that a carrier plate and a stopper member of the window regulator make with respect to a plane perpendicular to an axis of a guide rail.
Figure 4A:
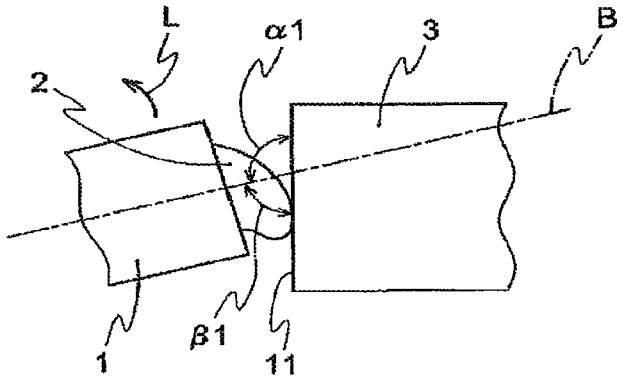
FIG. 4A PRIOR ART
FIGS. 4A and 4B are drawings for explaining a collision angle between the stopper member and an impact absorbing body used in the window regulator.
Figure 4B:
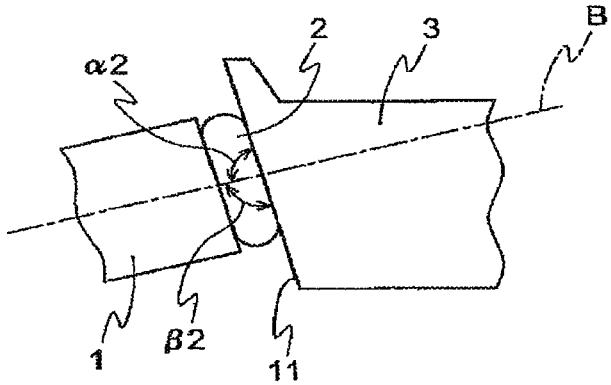
Figure 5:
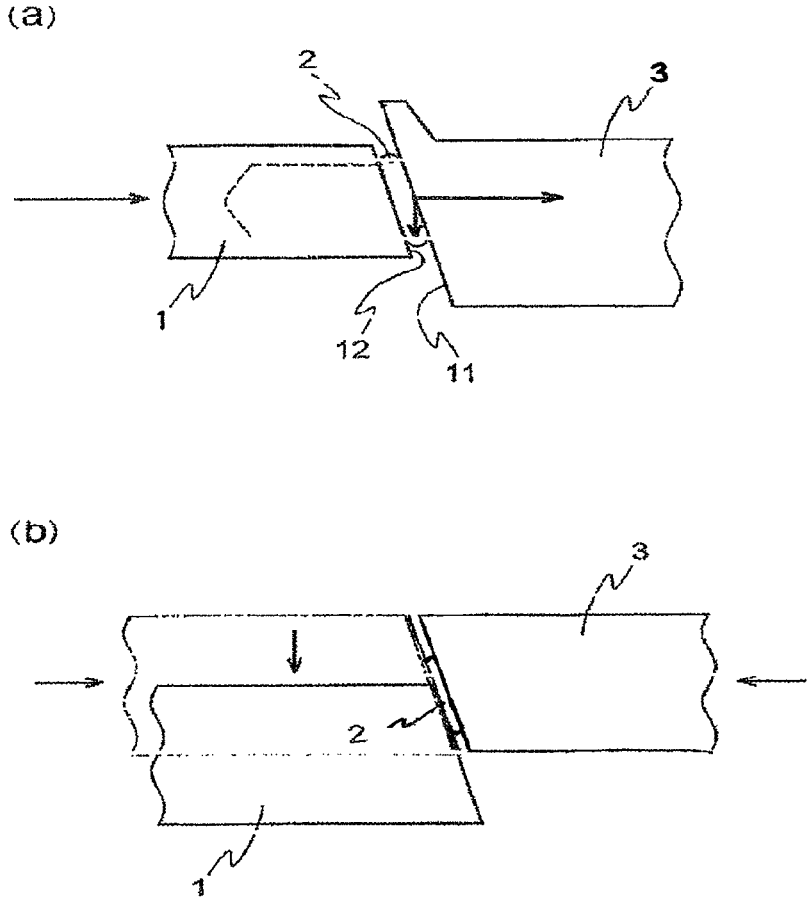
FIGS. 5A and 5B are drawings for explaining forces that occur due to a tilt provided on the carrier plate and the stopper member.

FIG. 1 is a drawing for explaining a window regulator 20. FIG. 2 is a cross sectional view of the window regulator 20 of FIG. 1 taken along a section line I-I. FIG. 3 is a drawing for explaining an angle that a carrier plate and a stopper member of the window regulator 20 make with respect to a plane perpendicular to an axis of a guide rail. FIGS. 4A and 4B are drawings for explaining a collision angle between the stopper member and an impact absorbing body used in window regulator 20. FIGS. 5A and 5B are drawings for explaining forces that occur due to a tilt provided on the carrier plate and the stopper member.

The window regulator 20 according to this embodiment will now be explained with reference to FIG. 1. The window regulator 20 is configured to open and close a window pane of a vehicle or the like and has a carrier plate 1 and a guide rail 6. The carrier plate 1 comprises a guide rail fitting section 7 that fits together with the guide rail 6, a window pane fastening section 8, and connecting sections 10*a* and 10*b*. The connecting sections 10*a* and 10*b* secure wire ends Ca and Cb that are fastened to wires 4*a* and 4*b*. The wires 4*a* and 4*b* serve as a power transmitting means for transmitting power generated by a drive section 9 to the carrier plate 1.

The carrier plate 1 is connected to the guide rail 6 by the guide rail fitting section 7 and is fitted such that it can be slid up and down the guide rail 6 by power generated by the drive section 9. The drive section 9 is equipped with an electric motor and has a recess in which a rotary drum (not shown in the drawings) is rotatably housed. One end of each of the wires 4*a* and 4*b* (which serve as a power transmitting means) is secured to the rotary drum. Power (e.g., rotary torque) generated by the electric motor is transmitted through a reduction gear mechanism to the rotary drum such that, for example, one wire 4*a* is wound in and the other wire 4*b* is reeled out. When this occurs, the carrier plate 1 moves along the guide rail 6 because the other ends of the wires 4*a* and 4*b* are secured to the carrier plate 1 by the cable ends Ca and Cb.

The carrier plate 1 can be formed as a one-piece integral unit made of a synthetic resin (e.g., such an engineering plastic as polyamide or polyacetal, or another synthetic resin having superior mechanical properties). It is also possible to fabricate the carrier plate 1 of separate entities fastened together by heat fusion, screw connections, or another fastening means. Also, the material of the carrier plate 1 is not limited to a synthetic resin; it is also acceptable to make the carrier plate 1 out of metal or a combination of metal and synthetic resin.

A window pane fastening section 8 for fastening a window pane is provided on the carrier plate 1, and the window pane fastening section 8 provided on the carrier plate 1 has a hole for inserting a bolt to fastening a vehicle window pane (not shown) to the carrier plate 1.

In this embodiment, the guide rail fitting section 7 is a claw configured to engage with a lengthwise side edge of the guide rail 6 (see FIG. 2), but there are no particular limitations on the form of the guide rail fitting section 7.

A stopper member 3 that restricts a lower end position of the carrier plate 1 is provided as an integral part of the drive section 9. When the window pane is lowered, the carrier plate 1 is stopped at a lower end position due to the carrier plate 1 contacting the stopper member 3. Since the stopper member 3 is provided as an integral unit with the drive section 9, the number of parts of the window regulator can be reduced and a force acting on the stopper member can be supported by the entire housing. Consequently, a stiffness of the stopper member can be increased.

An impact absorbing body 2 is provided on the carrier plate 1 to reduce an impact and emission of a hitting sound occurring when the carrier plate 1 and the stopper member 3 contact each other. The impact absorbing body 2 is installed in a press fitting recess 5 provided in the carrier plate 1. The impact absorbing body 2 can be reliably supported by installing it into the press fitting recess.

The impact absorbing body 2 is made of a chloroprene rubber or other elastic material having a generally column-like shape that is substantially rectangular. A damping section 21 is formed on a side of the impact absorbing body 2 that contacts the stopper member 3. In this embodiment, the damping section 21 is substantially shaped like a four-sided pyramid such that it narrows toward a tip end. Since the tip end is narrow, the stopper member 3 and impact absorbing body 2 do not undergo a surface-to-surface contact and, thus, emission of a hitting sound can be reduced.

Although in this embodiment the impact absorbing body has a generally rectangular shape, there are no particular limitations on the shape of the impact absorbing body 2 and a column-like body having substantially the shape of a circular column, a triangular column, a rectangular column, or a pentagonal column can be used. The shape of the press fitting recess 5 can also be changed as appropriate in accordance with the shape of the impact absorbing body 2.

Although in this embodiment the press fitting recess section 5 is formed in the carrier plate 1, it is also possible to form a press fitting recess section 5 in the stopper member 3 and not form a press fitting recess section 5 in the carrier plate 1.

A collision surface 11 of the stopper member 3 that collides with the impact absorbing body 2 is shaped such that the carrier plate 1 is pushed down toward the guide rail 6 when the impact absorbing body 2 collides against the collision surface 11. In the example shown in FIG. 3, the collision surface 11 is a tilted surface. A shape that pushes the carrier plate down toward the guide rail is a shape that can bear a force oriented toward the guide rail when the carrier plate collides with the impact absorbing body, i.e., a force that includes a force component acting in a direction opposite to a direction in which the carrier plate would lift up off the guide rail and become derailed. So long as it has such a shape, it is acceptable if the collision surface 11 is curved so as to be recessed toward the guide rail or provided with a particular form of recess and protrusion. Meanwhile, an opposing surface 12 that faces toward the stopper member 3 is formed around a perimeter of the press fitting recess 5 of the carrier plate 1.

As shown in FIG. 3, the collision surface 11 of the stopper member 3 is tilted toward the carrier plate 1 by an angle $\theta$ with respect to a plane V1 that is perpendicular to an axis AX of the guide rail 6. The opposing surface 12 of the carrier plate 1 is tilted away from the stopper member 3 by the same angle $\theta$ as the collision surface 11 with respect to a plane V2 that is perpendicular to the axis AX of the guide rail 6. The tilt angle $\theta$ is preferably 5 to 20 degrees, and still more preferably 10 to 15 degrees. This angle is determined by a gap size between the guide rail fitting section 7 of the carrier plate 1 and the guide rail 6, and it is preferably set such that when the carrier plate 1 is fitted together with the guide rail 6 and tilted to a maximum possible angle, an axis of the impact absorbing body 2 is perpendicular to the collision surface 11.

A force acting in a direction of derailing the carrier plate 1 from the guide rail 6 occurs when an angle $\alpha 1$ and an angle $\beta 1$ between the collision surface 11 of the stopper member 3 and an axis B of the impact absorbing body 2 have the relationship $\alpha 1>\beta 1$, as shown in FIG. 4A. When the relationship $\alpha 1>\beta 1$ occurs, the impact absorbing body 2 assumes a flexed state because it contacts the stopper member 3 in a tilted state and a force acts to rotate the carrier plate 1 in the direction of the arrow L. With this embodiment, a tilt is provided on the stopper member 3 as shown in FIG. 4B such that the angles $\alpha 2$ and $\beta 2$ between the collision surface 11 of the stopper member 3 and the axis B of the impact absorbing body 2 have the relationship $\alpha 2=\beta 2$ or $\alpha 2<\beta 2$. When $\alpha 2=\beta 2$, the impact absorbing body 2 is evenly compressed by the stopper member 3. As a result, the impact absorbing body 2 does not easily become flexed and a force acting to rotate the carrier plate 1 in the direction of the arrow L does not easily occur. Meanwhile, when $\alpha 2<\beta 2$, the impact absorbing body 2 flexes similarly to when $\alpha 1>\beta 1$, but it is difficult for a force acting to rotate the carrier plate 1 to develop because the collision surface 11 of the stopper member 3 suppresses rotation of the carrier plate 1 in the direction of the arrow L.

Additionally, FIG. 5A illustrates a state in which the impact absorbing body 2 is compressed by the stopper member 3 such that the relationship $\alpha 1=\beta 1$ exists. In this state, since the collision surface 11 of the stopper member 3 and the opposing surface 12 of the carrier plate 1 are configured to be parallel to each other, the impact absorbing body 2 can be compressed evenly as when the impact absorbing body 2 and the stopper member 3 contact each other in a surface-to-surface manner. Thus, it is difficult for the impact absorbing body 2 to flex and difficult for a force to act so as to rotate the carrier plate 1 in the direction of the arrow L. As a result, as depicted in FIG. 5B, the collision surface 11 exerts a force against the carrier plate 1 in a downward direction, i.e., in a direction of preventing the carrier plate 1 from derailing from the guide rail 6.

Thus, by providing a tilted surface on each of the carrier plate 1 and the stopper member 3, the carrier plate 1 can be prevented from separating from the guide rail 6 with a simple structure. Also, since a force does not acting in a direction of separating the carrier plate 1, there are no particular limitations on the shape of the impact absorbing body 2.

Figure 6:
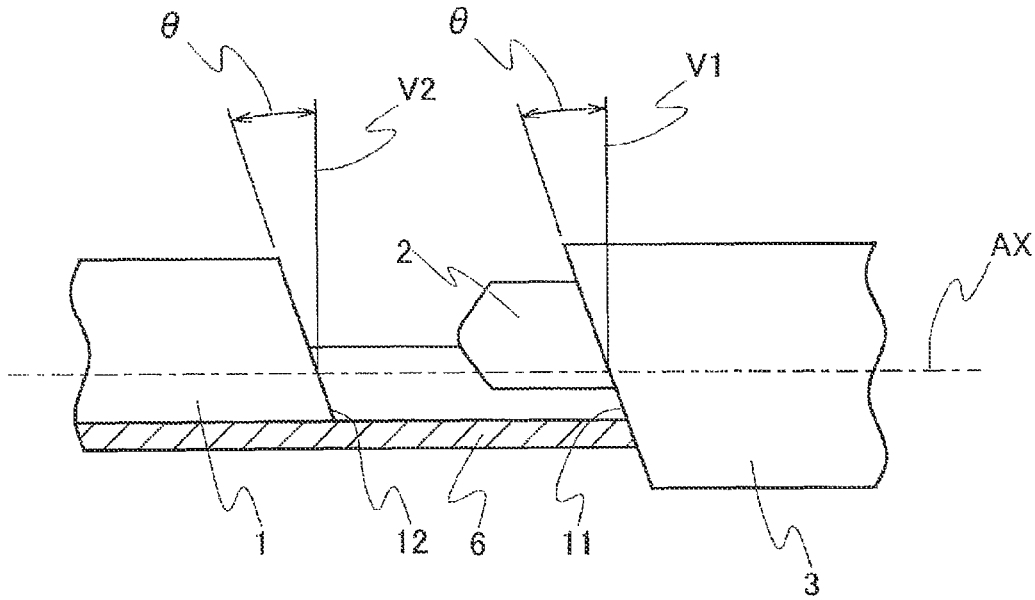
FIG. 6 is a drawing for explaining a carrier plate and a stopper member of a window regulator according to another embodiment.
Figure 7A:
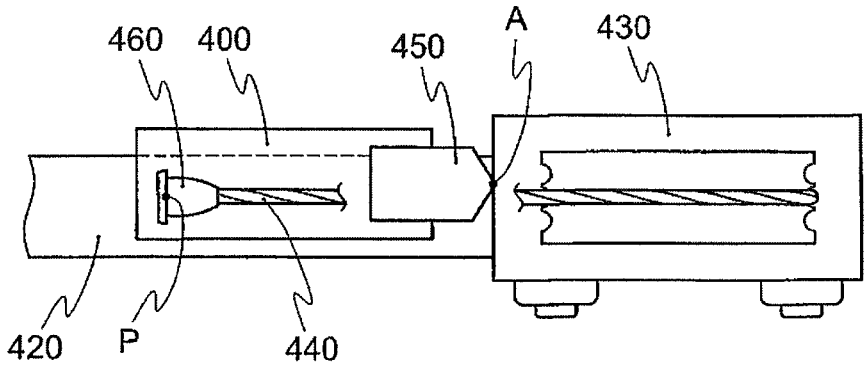
FIG. 7A PRIOR ART
FIGS. 7A, 7B and 7C are a drawing illustrating a carrier plate derailed from a guide rail in a conventional window regulator.
Figure 7B:
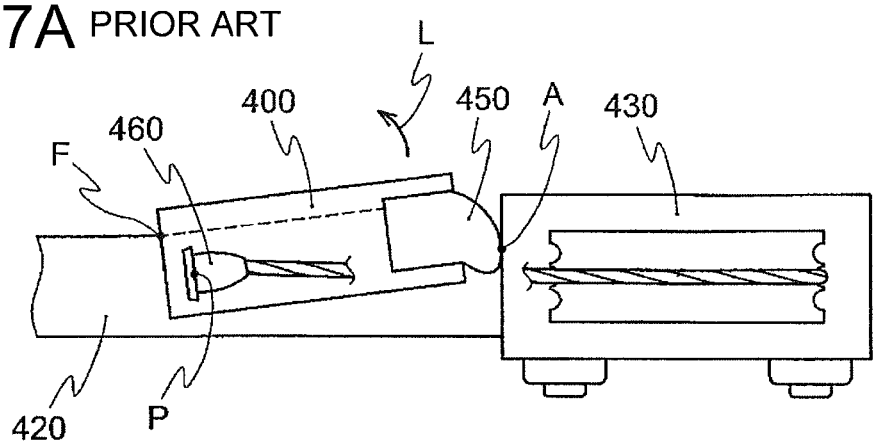
FIG. 7B PRIOR ART
Figure 7C:
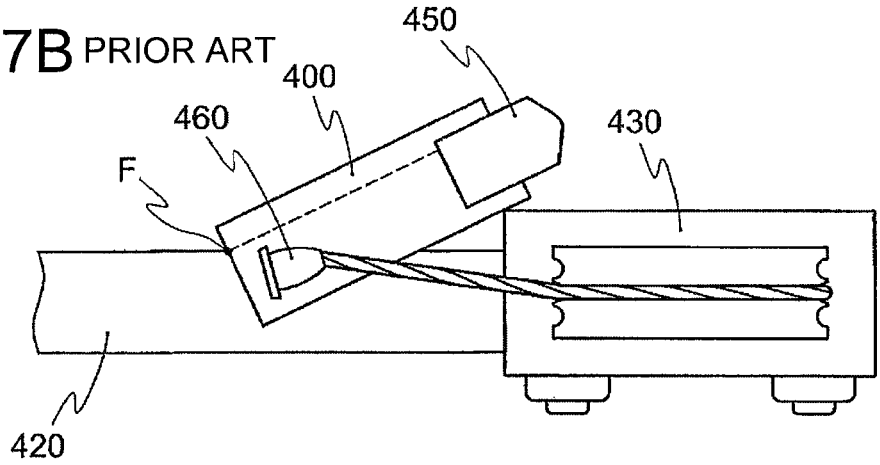
FIG. 7C PRIOR ART

Although in this embodiment the impact absorbing body 2 is provided on the carrier plate 1, the principle is the same if the impact absorbing body 2 is provided on the stopper member 3 (see FIG. 6). As a result, as depicted in FIG. 5B, by providing a similar collision surface on the carrier plate, the collision surface 11 exerts a force against the carrier plate 1 in a downward direction such that the carrier plate 1 can be prevented from derailing from the guide rail 6.

Additionally, since the collision surface is a tilted surface in this embodiment, there are not limitations on the cross sectional shape, i.e., it is acceptable if the cross sectional shape is circular arc-shaped or U-shaped.

The invention claimed is:

1. A window regulator comprising:

a guide rail configured to be fixed to a door of a vehicle;

a carrier plate slidably attached to the guide rail, the carrier plate comprising a guide rail fitting section that fits together with the guide rail, a window pane fastening section, and a connecting section that connects to a power transmitting part that transmits power generated by a drive section; and a stopper member that regulates a slide position of the carrier plate, one of the carrier plate and the stopper member having an opposing surface and an impact absorbing body made of an elastic material attached to the opposing surface;

the other of the stopper member and the carrier plate having a collision surface positioned to collide with the impact absorbing body, the collision surface being a first tilted surface forming a first acute angle with respect to the guide rail, and the opposing surface facing the collision surface and being a second tilted surface forming a second acute angle with respect to the guide rail; and the impact absorbing body being positioned to engage the collision surface when the opposing surface moves toward the collision surface to bias the carrier plate toward the guide rail to prevent rotation of the carrier plate in a direction of derailing the carrier plate from the guide rail.

2. The window regulator recited in claim 1, wherein the opposing surface is parallel to the collision surface.

3. The window regulator according to claim 2, wherein the opposing surface has a recess for attaching the impact absorbing body.

4. The window regulator according to claim 1, wherein the stopper member is provided as an integral unit with a housing of the drive section.

5. A window regulator comprising:

a guide rail configured to be fixed to a door of a vehicle;

a carrier plate slidably attached to the guide rail, the carrier plate comprising a guide rail fitting section that fits together with the guide rail, a window pane fastening section, and a connecting section that connects to a power transmitting part that transmits power generated by a drive section; and a stopper member that regulates a slide position of the carrier plate, one of the carrier plate and the stopper member having an opposing surface and an impact absorbing body made of an elastic material attached to the opposing surface;

the other of the stopper member and the carrier plate having a collision surface for colliding with the impact absorbing body, the collision surface being a first tilted surface forming a first acute angle with respect to the guide rail, and the opposing surface facing the collision surface and being a second tilted surface forming a second acute angle with respect to the guide rail; and the impact absorbing body including means for biasing the carrier plate toward the guide rail when the opposing surface moves toward the collision surface.

6. The window regulator recited in claim 5, wherein the opposing surface that faces the collision surface is parallel to the collision surface.

7. The window regulator recited in claim 6, wherein the opposing surface has a recess for attaching the impact absorbing body.

8. The window regulator according to claim 5, wherein the stopper member is provided as an integral unit with a housing of the drive section.

* * * * *